US008381622B2

(12) United States Patent
Roppolo

(10) Patent No.: US 8,381,622 B2
(45) Date of Patent: Feb. 26, 2013

(54) HAND TOOL FOR ASSEMBLING AND DISASSEMBLING WORKPIECES

(76) Inventor: Kyle Roppolo, Long View, TX (US)

( * ) Notice: Subject to any disclaimer, the term of this patent is extended or adjusted under 35 U.S.C. 154(b) by 482 days.

(21) Appl. No.: 12/537,730

(22) Filed: Aug. 7, 2009

(65) Prior Publication Data

US 2010/0162859 A1 Jul. 1, 2010

Related U.S. Application Data

(60) Provisional application No. 61/087,333, filed on Aug. 8, 2008.

(51) Int. Cl.
*B25B 7/14* (2006.01)

(52) U.S. Cl. ..... 81/321; 81/318; 81/324

(58) Field of Classification Search ..... 81/318, 81/321, 324

See application file for complete search history.

(56) References Cited

U.S. PATENT DOCUMENTS 3,161,094 A 12/1964 Johnson
D258,411 S * 3/1981 Futami ..... D8/4
4,825,735 A 5/1989 Undin
5,187,968 A * 2/1993 Beetz et al. ..... 72/409.08
6,286,358 B1 * 9/2001 Beetz et al. ..... 72/409.12
6,807,728 B2 * 10/2004 Griffin et al. ..... 29/751

* cited by examiner

*Primary Examiner* — Joseph J Hail
*Assistant Examiner* — Shantese McDonald
(74) *Attorney, Agent, or Firm* — Aiden baum Schloff and Bloom PLLC; Jay Schloff

(57) ABSTRACT

A hand tool for assembling and disassembling a plurality of workpieces is provided. The hand tool comprises a pair of handle members, a pair of intermediate members pivotally coupled to the pair of handle members, a pair of jaw members pivotally coupled to the pair of intermediate members, a spring member mounted between the pair of handle members, and a locking mechanism configured on the pair of handle members. Accordingly, upon applying a grasping force to the pair of handle members, the spring member is compressed and the pair of intermediate members converge towards each other thereby allowing the pair of jaw members to grasp the at least a portion of the workpiece therebetween for assembling and disassembling the plurality of workpieces. Further, upon grasping the at least a portion of the workpiece, the pair of handle members are held in a locked state by the locking mechanism.

3 Claims, 6 Drawing Sheets

HAND TOOL FOR ASSEMBLING AND DISASSEMBLING WORKPIECES

CROSS REFERENCE TO RELATED APPLICATIONS

The present disclosure claims priority under 35 United States Code, Section 119 on the U.S. Provisional Patent Application No. 61/087,333 filed on Aug. 8, 2008, the disclosure of which is incorporated by reference.

FIELD OF THE DISCLOSURE

The present disclosure generally relates to hand tools, and, more particularly to a hand tool for assembling and disassembling a plurality of workpieces, such as duct pieces.

BACKGROUND OF THE DISCLOSURE

Typically, duct systems are used for transporting air, fumes, dust, and heat from one area to another area in a commercial or residential building structure. Mostly, the duct systems include a plurality of workpieces, such as duct pieces, assembled together to form a long duct, used for transporting air, heat, and the like, from the one area to another area. The workpieces of a duct system are generally fabricated from sheet metal with the help of tools. For example, while fabricating a small workpiece two pieces of sheet are assembled along the edges thereof with the help of a hammer. In case of bigger workpieces, four pieces of sheet are assembled along the edges thereof. Further, for the purpose of maintenance or in case of any error, the assembled workpieces may be disassembled from each other with the help of conventional hand tools, such as hammers, screwdrivers, and pliers.

Typically, such hand tools require an individual to use both hands for operating the hand tool while assembling or dissembling the workpieces. For example, while disassembling the workpieces, such as duct pieces, the hand tool needs to be opened and closed repeatedly. Once closed, the opening of the hand tool may be achieved by manually separating handles of the hand tool. Such manual separation necessitates an individual to utilize both hands thereof. The use of both hands for separation the handles of the hand tool restricts the use of the hands of the individual for performing other tasks associated with the disassembling of the workpieces. Accordingly, the use of conventional hand tools may be time consuming for disassembling the workpieces, such as duct pieces.

Moreover, assembling the workpieces together using the conventional hand tool necessitates requirement of an additional support for gripping the workpieces. Specifically, for assembling two workpieces, edges of the two workpieces are brought together so as to overlap with each other. The overlapped edges are held close to each other by utilizing a conventional hand tool. Thereafter, the overlapped edges are permanently coupled together by sliding a connector, such as a cleat, throughout the length of the overlapped edges. However, utilizing the conventional hand tool for assembling the workpieces has a few disadvantages. Specifically, for holding the overlapped edges together, the individual has to hold the pair of handles of the hand tool closed to each other, thereby allowing the coupling of the overlapping edges with the connector. The need of holding the handles of the hand tool for gripping the workpieces together restricts the use of the hands of the individual for sliding the connector. This necessitates the requirement of another individual for holding the pair of handles of the hand tool while the individual slides the connector throughout the length of the overlapped edges of the workpieces.

Moreover, the conventional hand tools may pose limitations while being utilized in confined spaces. For example, such hand tools may not be able to be utilized for assembling, disassembling or maintenance of the workpieces mounted in proximity to a wall or a pipe.

Accordingly, there exists a need for a hand tool that is capable of being used for assembling and disassembling workpieces, such as duct pieces, in a convenient and time efficient manner. Further, there exists a need for a hand tool capable of being used in a confined space for assembling and disassembling of workpieces.

SUMMARY OF THE DISCLOSURE

In view of the forgoing disadvantages inherent in the prior-art, the general purpose of the present disclosure is to provide a hand tool for assembling and disassembling workpieces, to include all advantages of the prior art, and to overcome the drawbacks inherent in the prior art.

Accordingly, an object of the present disclosure is to provide a hand tool that may be operated by using a single hand of an individual while assembling or disassembling workpieces, such as duct pieces.

Another object of the present disclosure is to provide a hand tool capable of gripping and holding workpieces together without a support of an individual's hand.

Yet another object of the present disclosure is to provide a hand tool capable of being used in a confined space for assembling and disassembling the workpieces.

To achieve the above objects, the present disclosure provides a hand tool for assembling and disassembling a plurality of workpieces. The hand tool comprises a pair of handle members, a pair of intermediate members, a pair of jaw members, a spring member, and a locking mechanism. The each handle member of the pair of handle members comprises a top end portion, a bottom end portion, and a coupling portion extending sideways from the top end portion. The pair of handle members is pivotally coupled to each other at respective coupling portions. Each intermediate member of the pair of intermediate members comprises a lower end portion, an upper end portion, and an attaching portion extending between the upper end portion and the lower end portion. The lower end portion of each of the pair of intermediate members is pivotally coupled to the top end portion of respective handle member of the pair of handle members. Further, the pair of intermediate members is pivotally coupled to each other at respective attaching portions.

Each of the pair of jaw members is pivotally coupled to the upper end portion of respective intermediate member of the pair of intermediate members. The pair of jaw members is capable of grasping at least a portion of a workpiece of the plurality of workpieces therebetween. The spring member is mounted between the pair of handle members. The spring member is capable of being compressed and retracted based on a pivotal movement of the pair of handle members. The locking mechanism is configured on the pair of handle members. The locking mechanism is adapted to enable the pair of handle members to attain one of a locked state and an unlocked state. Accordingly, upon applying a grasping force to the pair of handle members, the spring member is compressed and the pair of intermediate members converge towards each other, thereby allowing the pair of jaw members to grasp the at least a portion of the workpiece therebetween for assembling and disassembling the plurality of workpieces. Further, upon grasping the at least a portion of the workpiece, the pair of handle members are held in the locked state by the locking mechanism. Moreover, upon attaining the unlocked state of the locking mechanism and releasing the grasping force from the pair of handle members, the spring member is retracted and the pair of intermediate members separate from each other, thereby allowing the pair of jaw members to release the grasp from the at least a portion of the workpiece.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a hand tool for assembling and disassembling a plurality of workpieces, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides a hand tool for assembling and disassembling a plurality of workpieces. More specifically, the hand tool may be used for assembling and disassembling the plurality of workpieces, such duct pieces, used in a duct system. For example, the hand tool is capable of being used for assembling a plurality duct pieces together to form a long duct that may be used for transporting air, heat, and the like, from one area to another area in a commercial or residential building structure. The hand tool of the present disclosure is capable of being used by the single hand of an individual while the individual is assembling and disassembling the plurality of workpieces. Further, the hand tool is capable of gripping workpieces together without a support of the individual's hand. Moreover, the hand tool of the present disclosure is capable of being used in a confined space for assembling and disassembling workpieces.

Figure 1:
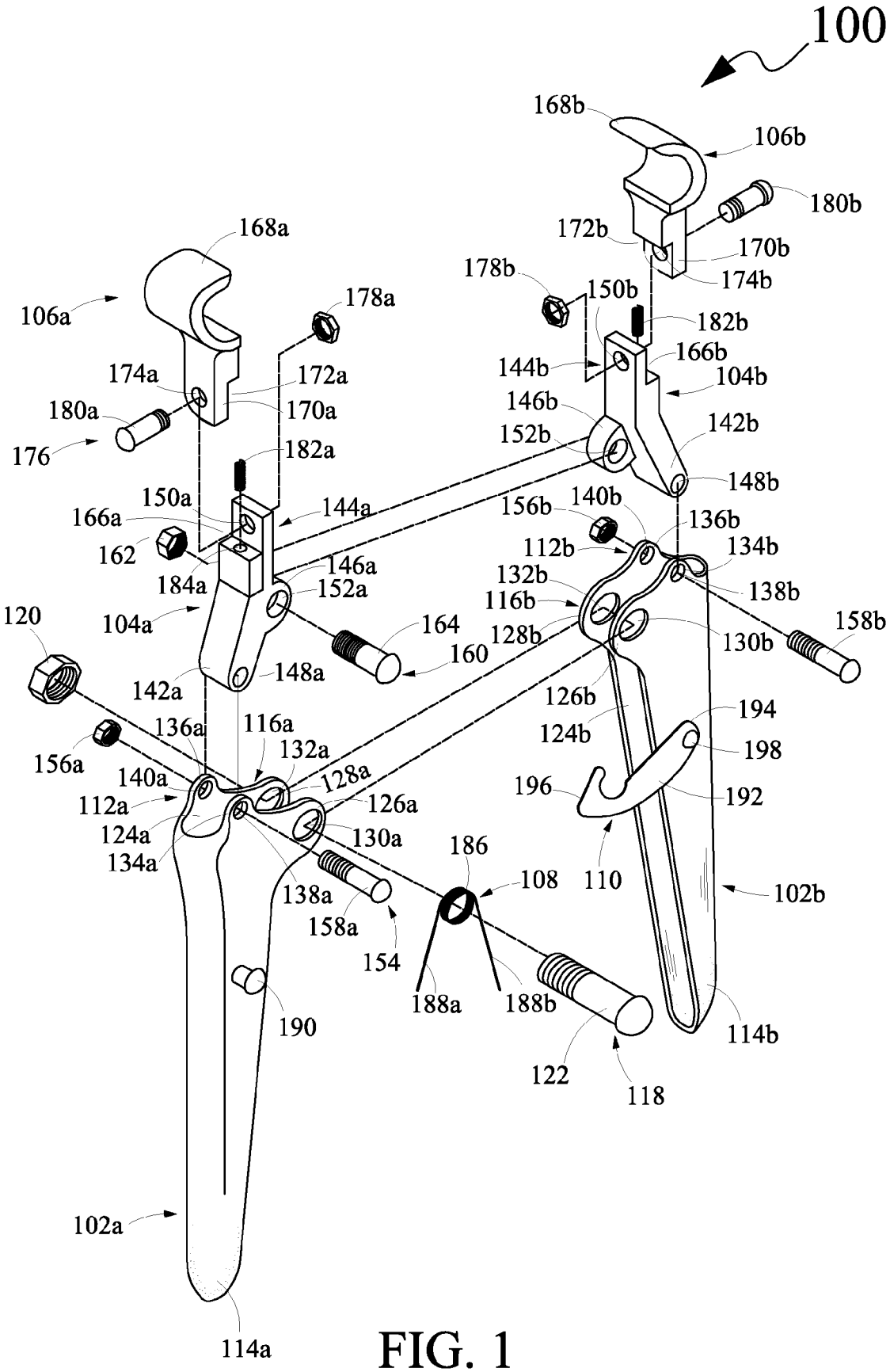
FIG. 1 illustrates an exploded perspective view of a hand tool for assembling and disassembling a plurality of work pieces, in accordance with an embodiment of the present disclosure.
Figure 2A:
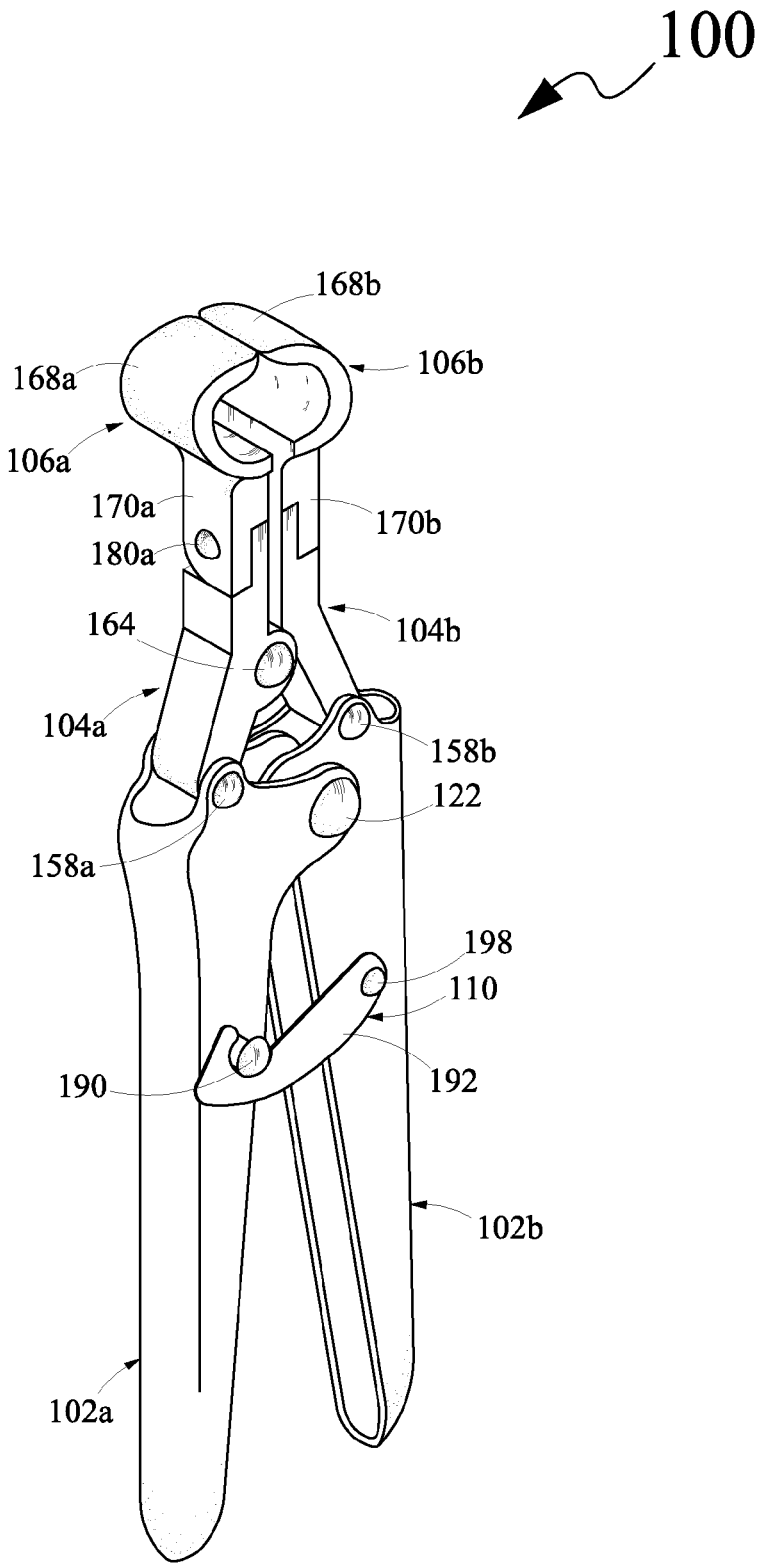
FIG. 2A illustrates a perspective view of the hand tool of FIG. 1 in a locked state, in accordance with an embodiment of the present disclosure.
Figure 2B:
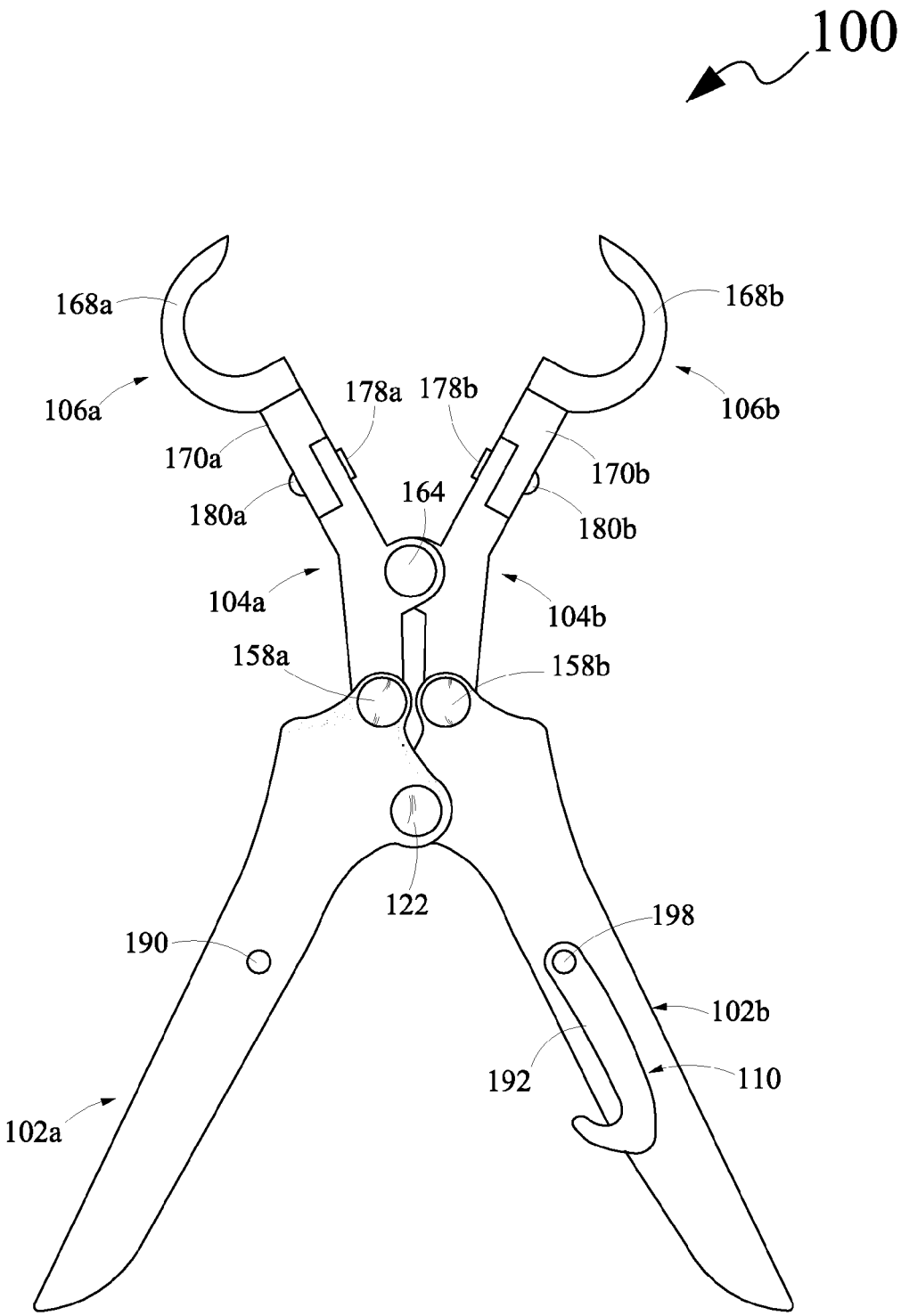
FIG. 2B illustrates a front view of the hand tool of FIGS. 1 and 2A in an unlocked state, in accordance with an embodiment of the present disclosure.

Referring to FIGS. 1, 2A, and 2B, various views of a hand tool 100 for assembling and disassembling a plurality of work pieces are illustrated, in accordance with the embodiments of the present disclosure. More specifically, FIG. 1 illustrates an exploded perspective view of the hand tool 100, FIG. 2A illustrates a perspective view of the hand tool 100 in a locked state, and FIG. 2B illustrate a front view of the hand tool 100 in an unlocked state.

As shown in FIG. 1, the hand tool 100 includes a pair of handle members, such as a first handle member 102*a* and a second handle member 102*b* (hereinafter collectively referred to as a pair of handle members 102*a*, 102*b*), a pair of intermediate members, such as a first intermediate member 104*a* and a second intermediate member 104*b* (hereinafter collectively referred to as a pair of intermediate members 104*a*,104*b*) coupled to the pair of handle members 102*a*, 102*b*, a pair of jaw members, such as a first jaw member 106*a* and a second jaw member 106*b* (hereinafter collectively referred to as a pair of jaw members 106*a*, 106*b*) coupled to the pair of intermediate members 104*a*, 104*b*, a spring member 108 mounted between the pair of handle members 102*a*, 102*b*, and a locking mechanism 110 configured on the pair of handle members 102*a*, 102*b*.

The each handle member of the pair of handle members 102*a*, 102*b* includes a top end portion, a bottom end portion, and coupling portion extending sideways from the top end portion. More specifically, the first handle member 102*a* includes a top end portion 112*a*, a bottom end portion 114*a*, and a coupling portion 116*a* extending sideways from the top end portion 112*a*. Similarly, the second handle member 102*b* includes a top end portion 112*b*, a bottom end portion 114*b*, and a coupling portion 116*b* extending sideways from the top end portion 112*b*. The pair of handle members 102*a*, 102*b* is pivotally coupled to each other at respective coupling portions 116*a* and 116*b*.

In one embodiment of the present disclosure, the pair of handle members 102*a*, 102*b* is pivotally coupled to each other at the respective coupling portions 116*a* and 116*b* by a first nut and bolt arrangement 118. The first nut and bolt arrangement 118 includes a first nut 120 and a first bolt 122 capable of being threadably coupled to the first nut 120. More specifically, the first bolt 122 of the first nut and bolt arrangement 118 is capable of being received by the coupling portions 116*a* and 116*b* and thereafter threadably coupled to the first nut 120 for enabling the pivotal coupling of the pair of handle members 102*a*, 102*b*. The pivotal coupling of the pair of handle members 102*a*, 102*b* is explained later with reference to FIG. 1. Further, it will be evident to those skilled in the art that the pair of handle members 102*a*, 102*b* may be pivotally coupled to each other by any suitable fastening mechanism other than the first nut and bolt arrangement 118, such as a rivet arrangement.

As shown in FIG. 1, each of the pair of handle members 102*a*, 102*b* includes a channel running along a length thereof. For example, the first handle member 102*a* includes a channel 124*a* and the second handle member 102*b* includes a channel 124*b* running along the lengths thereof. Therefore, each of the coupling portions 116*a* and 116*b* of the pair of handle members 102*a*, 102*b*, respectively, includes a pair of coupling flanges parallely spaced apart. For example, the coupling portion 116*a* includes a pair of coupling flanges 126*a* and 128*a* parallely spaced apart. Further, each of the pair of coupling flanges 126*a* and 128*a* includes a first through hole configured thereon. Specifically, the pair of coupling flanges 126*a* and 128*a* includes first through holes 130*a* and 132*a*, respectively configured thereon. Similarly, the coupling portion 116*b* of the second handle member 102*b* includes a pair of coupling flanges 126*b* and 128*b* parallely spaced apart. Moreover, the pair of coupling flanges 126*b* and 128*b* includes first through holes 130*b* and 132*b*, respectively configured thereon.

In the present embodiment, a distance between the pair of coupling flanges 126*b* and 128*b* is smaller as compare to a distance between the pair of coupling flanges 126*a* and 128*a*. Accordingly, the pair of coupling flanges 126*b* and 128*b* is capable of being received within the pair of coupling flanges 126*a* and 128*a*. Further, the first through holes 130*a* and 132*a* of the pair of coupling flanges 126*a* and 128*a*, respectively, and the first through holes 130*b* and 132*b* of the pair of coupling flanges 126*b* and 128*b*, respectively, are aligned for receiving the first bolt 122 therethrough. Thereafter, the first nut 120 is threadably coupled to the first bolt 122 for facilitating the pivotal coupling between the pair of handle members 102*a*, 102*b*.

The pair of handle members 102*a*, 102*b* is further pivotally coupled to the pair of intermediate members 104*a*, 104*b*. More specifically, the top end portions 112*a* and 112*b* of the first handle member 102*a* and the second handle member 102*b*, respectively, are pivotally coupled to the pair of intermediate members 104*a*, 104*b*. In the present embodiment, each of the top end portions 112*a* and 112*b* includes a pair of top coupling flanges parallely spaced apart. More specifically, the top end portion 112*a* of the first handle member 102*a* includes a pair of top coupling flanges 134*a* and 136*a* parallely spaced apart from each other. Further, the pair of top coupling flanges 134*a* and 136*a* include second through holes 138*a* and 140*a*, respectively configured thereon. Similarly, the top end portions 112*b* of the second handle member 102*b* includes a pair of top coupling flanges 134*b* and 136*b* parallely spaced apart. Moreover, the pair of top coupling flanges 134*b* and 136*b* include second through holes 138*b* and 140*b* respectively configured thereon.

As shown in FIG. 1, each of the pair of intermediate members 104*a*, 104*b* includes a lower end portion, an upper end portion, and an attaching portion extending between the upper end portion and the lower end portion. More specifically, the first intermediate member 104*a* includes a lower end portion 142*a*, an upper end portion 144*a*, and an attaching portion 146*a* extending between the upper end portion 144*a* and the lower end portion 142*a*. Similarly, the second intermediate member 104*b* includes a lower end portion 142*b*, an upper end portion 144*b*, and an attaching portion 146*b* extending between the upper end portion 144*b* and the lower end portion 142*b*. Further, each of the lower end portion, the upper end portion, and the attaching portion of the pair of intermediate members 104*a*, 104*b* includes a through hole configured thereon. For example, the lower end portion 142*a*, the upper end portion 144*a*, and the attaching portion 146*a* of the first intermediate member 104*a* include through holes 148*a*, 150*a*, and 152*a*, respectively configured thereon. Similarly, the lower end portion 142*b*, the upper end portion 144*b*, and the attaching portion 146*b* of the second intermediate member 104*b* include through holes 148*b*, 150*b* and 152*b*, respectively configured thereon.

The lower end portions 142*a* and 142*b* of the pair of intermediate members 104*a*, 104*b*, respectively, are pivotally coupled to the top end portions 112*a* and 112*b*, respectively, of the pair of handle members 102*a*, 102*b*. In the present embodiment, the pair of handle members 102*a*, 102*b* is pivotally coupled to the pair of intermediate members 104*a*, 104*b*, respectively, by a second nut and bolt arrangement 154. The second nut and bolt arrangement 154 includes a pair of second nuts 156*a* and 156*b* and a pair second bolts 158*a* and 158*b*.

Further, the lower end portions 142*a* and 142*b* of the pair of intermediate members 104*a*, 104*b*, respectively, are received between the pair of top coupling flanges 134*a* and 136*a*, and the pair of top coupling flanges 134*b* and 136*b*, respectively. Furthermore, the second through holes 138*a* and 140*a* of the pair of top coupling flanges 134*a* and 136*a*, respectively, are aligned with the through hole 148*a* of the lower end portion 142*a* of the first intermediate member 104*a*. Similarly, the second through holes 138*b* and 140*b* of the pair of top coupling flanges 134*b* and 136*b*, respectively, are aligned with the through hole 148*b* of the lower end portion 142*b* of the second intermediate member 104*b*. Moreover, the pair of second bolts 158*a* and 158*b* are received through the aligned holes and thereafter threadably coupled to the pair of second nuts 156*a* and 156*b*, respectively, for facilitating the pivotal coupling between the pair of intermediate members 104*a*, 104*b* and the pair of handle members 102*a*, 102*b*. For example, the second bolt 158*a* is received through the second through holes 138*a* and 140*a*, and the through hole 148*a* and thereafter threadably coupled to the second nut 156*a* for facilitating the pivotal coupling of the first intermediate member 104*a* with the first handle member 102*a*. Similarly, the second bolt 158*b* is received through the second through holes 138*b* and 140*b*, and the through hole 148*b* and thereafter threadably coupled to the second nut 156*b* for enabling the pivotal coupling of the second intermediate member 104*b* with the second handle member 102*b*.

The pair of intermediate members 104*a*, 104*b* is further pivotally coupled to each other at respective attaching portions 146*a* and 146*b*. The attaching portion 146*a* is extending between the upper end portion 144*a* and the lower end portion 142*a* of the first intermediate member 104*a*, and the attaching portion 146*b* is extending between the upper end portion 144*b* and the lower end portion 142*b* of the second intermediate member 104*b*. Further, as shown in FIG. 1, thickness of the attaching portion 146*a* is about half thickness of the first intermediate member 104*a*, and similarly thickness of the attaching portion 146*b* is about half thickness of the second intermediate member 104*b*. Accordingly, due the half thickness of the attaching portions 146*a* and 146*b* enable in receiving the attaching portions 146*a* and 146*b* over each other such that the through hole 152*a* configured on the attaching portion 146*a* aligns with the through hole 152*b* configured on the attaching portion 146*b*. Therefore, the attaching portions 146*a* and 146*b* may be coupled to each other by a third nut and bolt arrangement 160 for facilitating the pivotal coupling between the pair of intermediate members 104*a*, 104*b*.

In the present embodiment, the third nut and bolt arrangement 160 includes a third nut 162 and a third bolt 164. The third bolt 164 is capable of being received through the aligned through holes 152*a* and 152*b* of the attaching portions 146*a* and 146*b*, respectively, and thereafter the third nut 162 is threadably coupled to the third bolt 164 for facilitating the pivotal coupling between the pair of intermediate members 104*a*, 104*b* at the respective attaching portions 146*a* and 146*b*.

The pair of intermediate members 104*a*, 104*b* is further pivotally coupled to the pair of jaw members 106*a*, 106*b*, respectively. More specifically, the pair of jaw members 106*a*, 106*b* is pivotally coupled to the upper end portions 144*a* and 144*b* of respective intermediate member of the pair of intermediate members 104*a*, 104*b*. As shown FIG. 1, each of the upper end portions 144*a* and 144*b* of the pair of intermediate members 104*a*, 104*b* includes a cutout portion. For example, the upper end portion 144*a* of the first intermediate member 104*a* includes a cutout portion 166*a* configured thereon and the upper end portion 144*b* of the second intermediate member 104*b* includes a cutout portion 166*b* configured thereon.

The cutout portions 166*a* and 166*b* of the upper end portions 144*a* and 144*b*, respectively, are capable of receiving the pair of jaw members 106*a*, 106*b* thereon. As shown in FIG. 1, each of the pair of jaw members 106*a*, 106*b* includes a gripping portion and a neck portion extending from the gripping portion. More specifically, the first jaw member 106*a* includes a gripping portion 168*a* and a neck portion 170*a* extending from the gripping portion 168*a*, and the second jaw member 106*b* includes a gripping portion 168*b* and a neck portion 170*b* extending from the gripping portion 168*b*.

In the present embodiment, the gripping portions 168*a* and 168*b* of the pair of jaw members 106*a*, 106*b* are configured to assume a C-shaped structure. Further, each of the neck portions 170*a* and 170*b* of the pair of jaw members 106*a*, 106*b* is configured to include a cutout portion and a through hole configured thereon. For example, the neck portion 170*a* of the first jaw member 106*a* includes a cutout portion 172*a* and a through hole 174*a*, and the neck portion 170*b* of the second jaw member 106*b* includes a cutout portion 172*b* and a through hole 174*b*. The cutout portions 172*a* and 172*b* of the neck portions 170*a* and 170*b*, respectively, are configuration-wise complementary to the cutout portions 166*a* and 166*b*, respectively.

Accordingly, the neck portions 170*a* and 170*b* of the pair of jaw members 106*a*, 106*b*, respectively, are capable of being received on the upper end portions 144*a* and 144*b* of the pair of intermediate members 104*a*, 104*b*. Further, the pair of jaw members 106*a*, 106*b* is pivotally coupled to the upper end portions 144*a* and 144*b* of respective intermediate member of the pair of intermediate members 104*a*, 104*b* by a fourth nut and bolt arrangement 176. The fourth nut and bolt arrangement 176 includes a pair of fourth nuts 178*a* and 178*b*, and a pair of fourth bolts 180*a* and 180*b*. The pair of fourth bolts 180*a* and 180*b* is capable of being received through the through holes configured on the neck portions 170*a* and 170*b*, and the upper end portions 144*a* and 144*b*. Thereafter, the pair of fourth bolts 180*a* and 180*b* is threadably coupled to the pair of fourth nuts 178*a* and 178*b*, respectively, for pivotally coupling the pair of intermediate members 104*a*, 104*b*, and the pair of jaw members 106*a*, 106*b*.

For example, upon aligning the through holes 174*a* and 150*a* configured on the neck portion 170*a* and the upper end portion 144*a*, respectively, the fourth bolt 180*a* is received through the through holes 174*a* and 150*a*. Thereafter, the fourth bolt 180*a* is threadably coupled to the fourth nut 178*a* for pivotally coupling the first intermediate member 104*a* with the first jaw member 106*a*. Similarly, upon aligning the through holes 174*b* and 150*b* configured on the neck portion 170*b* and the upper end portion 144*b*, respectively, the fourth bolt 180*b* is received through the through holes 174*b* and 150*b*. Thereafter, the fourth bolt 180*b* is threadably coupled to the fourth nut 178*b* for pivotally coupling the second intermediate member 104*b* with the second jaw member 106*b*.

As shown in FIG. 1, the hand tool 100 further includes a pair of retainer springs 182*a* and 182*b* mounted on the respective upper end portions 144*a* and 144*b* of each of the pair of intermediate members 104*a*, 104*b*. More specifically, the retainer spring 182*a* is received in a slot 184*a* configured on the upper end portion 144*a* of the first intermediate member 104*a*. Similarly, the retainer spring 182*b* is received in a slot (not shown) configured on the upper end portion 144*b* of the second intermediate member 104*b*. The pair of retainer springs 182*a* and 182*a* facilitate retaining of the pair of jaw members 106*a*, 106*a* at one or more predetermined angles (hereinafter referred to as the predetermined angles) with respect to the pair of intermediate members 104*a*, 104*b*, which is further explained in conjunction with FIG. 3.

Figure 3:
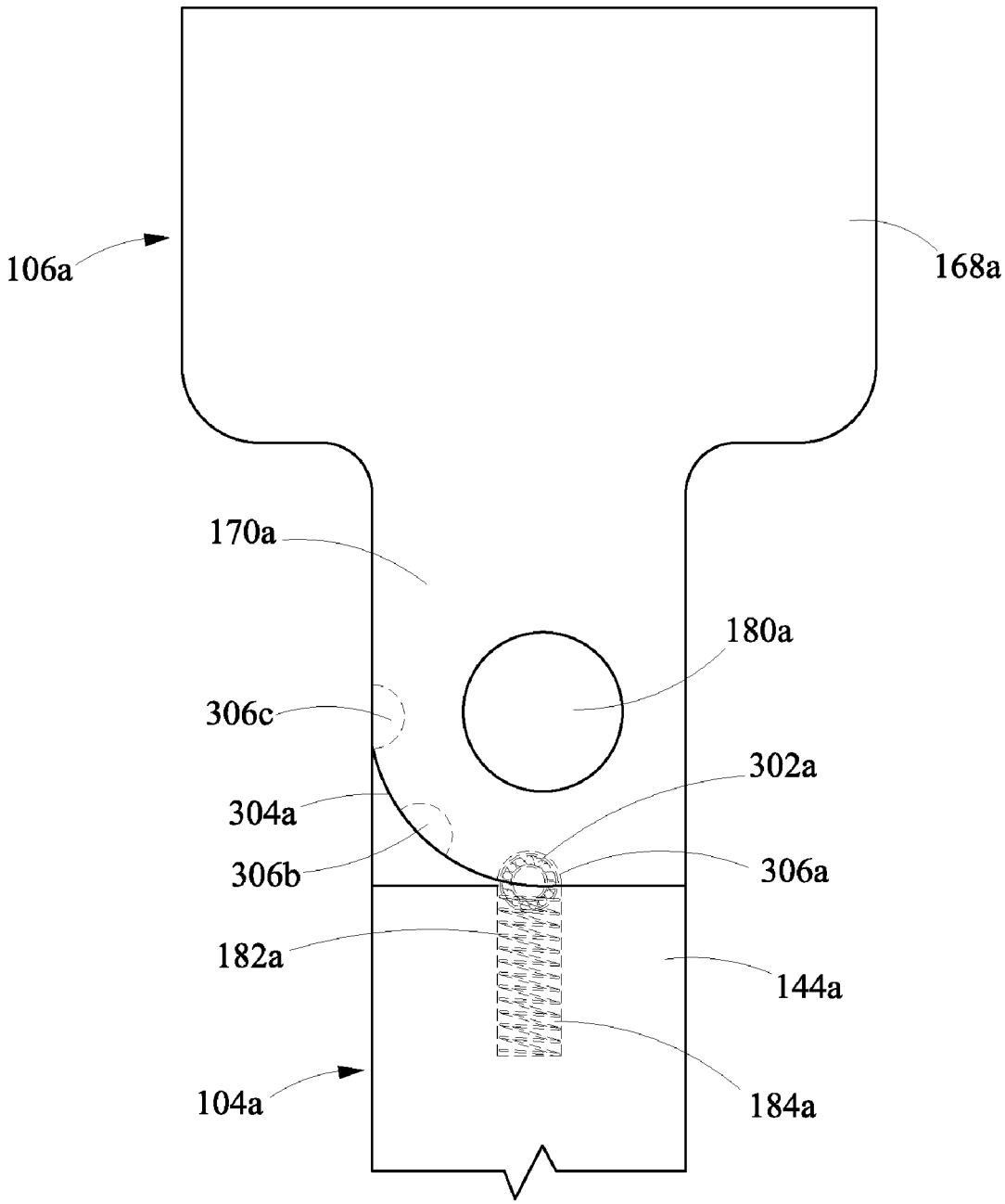
FIG. 3 illustrates a partial left hand side view of the hand tool of FIG. 2B, in accordance with an embodiment of the present disclosure.

Referring to FIG. 3, a partial left hand side view of the hand tool 100 of FIG. 2B is illustrated, in accordance with an embodiment of the present disclosure. Specifically, FIG. 3 illustrates the jaw member 106*a* being retained by the intermediate member 104*a* of the hand tool 100. The hand tool 100 includes a roller bearing 302*a* disposed on the retainer spring 182*a*. Further, the retainer spring 182*a* is received within the slot 184*a* configured on the upper end portion 144*a* of the first intermediate member 104*a*. It will be obvious to a person skilled in the art that the roller bearing 302*a*, the retainer spring 182*a*, and the slot 184*a* will be hidden upon the hand tool 100 being viewed from a side portion thereof, and accordingly, the roller bearing 302*a*, the retainer spring 182*a* and the slot 184*a* are shown by using hidden lines.

As shown in FIG. 3, the neck portion 178*a* of the jaw member 106*a* further includes a curved portion 304*a*. The curved portion 304*a* enables the jaw member 106*a* to pivotally move about the intermediate member 104*a*. More specifically, the curved portion 304*a* of the jaw member 106*a* provides a clearance between the jaw member 106*a* and the intermediate member 104*a* which allows the neck portion 170*a* of the jaw member 104*a* to move pivotally about the intermediate member 104*a*. For example, as shown in FIG. 3, the curved portion 304*a* is configured on a left side of the neck portion 170*a* of the jaw member 104*a*, and accordingly the jaw member 104*a* may be pivotally moved in an anticlockwise direction about the fourth bolt 180*a*.

The curved portion 304*a* of the jaw member 106*a* includes a plurality of indentations, such as indentations 306*a*, 306*b*, and 306*c* configured thereon. In the present embodiment, the plurality of indentations 306*a*, 306*b*, and 306*c* are semicircular cutouts, inwardly configured on the curved portion 304*a*. Accordingly, it will be evident to a person skilled in the art that the plurality of indentations 306*a*, 306*b*, and 306*c* are hidden when viewed in the side view of the hand tool 100 and, accordingly the plurality of indentations 306*a*, 306*b*, and 306*c* is shown by using hidden lines. The plurality of indentations 306*a*, 306*b*, and 306*c* is capable of partially receiving the roller bearing 302*a* therein. For example, the roller bearing 302*a* is partially received in the indentation 306*a*, as shown in FIG. 3.

In the present embodiment, the retainer spring 182*a* is received in the slot 184*a* in a compressed state thereof. The compressed retainer spring 182*a* pushes the roller bearing 302*a* in the indentation 306*a*. Further, the roller bearing 302*a* enables the jaw member 106*a* to be maintained at the predetermined angles with respect to the intermediate member 104*a*. More specifically, when the neck portion 170*a* of the jaw member 106*a* is pivotally moved, the roller bearing 302*a* enables the curved portion 304*a* to slide over the upper end portion 144*a* of the intermediate member 104*a* for allowing the roller bearing 302*a* to be received in one of the indentations 306*b* and 306*c*. Accordingly, when the roller bearing 302*a* is received in one the indentations 306*b* and 306*c*, the jaw member 106*a* may be retained at an angle, such as 45 degrees or 90 degrees, respectively, with respect to the intermediate member 104*a*. Otherwise, when the roller bearing 302*a* is received in the indentation 306*a*, the jaw member 106*a* is retained parallel to the intermediate member 104*a*. Furthermore, it will be evident to person skilled in the art that based on a number of indentations configured on the curved portion 304*a*; the jaw member 106*a* may be retained at various predetermined angles with respect to the intermediate member 104*a*.

Further, it will be evident to person skilled in the art that the hand tool 100 may include a roller bearing (not shown) disposed on the retainer spring 182*b* similar to the roller bearing 302*a* disposed on the retainer spring 182*a*, and a plurality of indentations (not shown) configured on the neck portion 170*b* of the jaw member 106*b* similar to the plurality of indentations 306*a*, 306*b*, and 306*c* configured on the neck portion 170*a* of the jaw member 106*a*. The roller bearing disposed on the retainer spring 182*b* and the plurality of indentations configured the neck portion 170*b* allows the jaw member 106*b* to be retained at the predetermined angles with respect to the intermediate member 104*b*. Accordingly, the pair of jaw members 106*a*, 106*b* may be retained at the predetermined angles with respect to the intermediate members 104*a*, 104*b* for allowing the hand tool 100 to be used in a confined space for assembling and disassembling the workpieces, which is further explained in conjunction with FIG. 5. Furthermore, it will be evident to person skilled in the art that the descriptions of the roller bearing disposed on the retainer spring 182*b*, and the plurality of indentations configured the neck portion 170*b* are avoided herein for the sake of brevity.

Referring back to FIG. 1, as explained herein, the spring member 108 is mounted between the pair of handle members 102*a*, 102*b*. More specifically, the spring member 108 is mounted on the first bolt 122 for pivotally coupling the coupling portions 116*a* and 116*b* of the pair of handle members 102*a*, 102*b*, respectively. The spring member 108 includes a coil portion 186 and a pair of spring wire portions 188*a* and 188*b* extending from the coil portion 186 in opposite direction to each other. The coil portion 186 of the spring member 108 is adapted to be mounted on the first bolt 122 in a manner such that the spring wire portion 188*a* is received in the channel 124*a* of the first handle members 102*a* and the spring wire portion 188*b* is received in the channel 124*b* of the second handle member 102*b*.

Further, the spring wire portion 188*a* touches a portion of an inner surface (not shown) of the first handle members 102*a* and the spring wire portion 188*b* touches a portion of an inner surface (not shown) of the second handle member 102*b*. Accordingly, the pair of spring wire portions 188*a* and 188*b* of the spring member 108 is capable of being compressed and retracted based on a pivotal movement of the pair of handle members 102*a*, 102*b*. More specifically, when the pair of handle members 102*a*, 102*b* are converged close to each other, the spring member 108, particularly the pair of spring wire portions 188*a* and 188*b*, is compressed and when the pair of handle members 102*a*, 102*b* are separated from each other, the spring member 108, particularly the pair of spring wire portions 188*a* and 188*b*, is retracted.

In the present embodiment, when the pair of handle members 102*a*, 102*b* is converged towards each other by applying a gripping force on the pair of handle members 102*a*, 102*b* the locking mechanism 110 is adapted to enable the pair of handle members 102*a*, 102*b* to attain a locked state, as shown and explained later in conjunction with FIG. 2A. Also, the locking mechanism 110 is adapted to enable the pair of handle members 102*a*, 102*b* to attain an unlocked state, as shown and explained later in conjunction with FIG. 2B.

Referring back to FIG. 1, the locking mechanism 110 includes a knob 190 configured on the first handle member 102*a* and a locking member 192 configured on the second handle member 102*b*. The locking member 192 includes a first end portion 194 rotatably coupled to a portion (not numbered) of the second handle member 102*b*, and a second end portion 196 adapted to be hooked on the knob 190 for allowing the locking mechanism 110 to attain the locked state. In the present embodiment, the rotatable coupling of the first end portion 194 with the portion of the second handle member 102*b* is enabled by a bolt member 198. However, it will be evident to a person skilled in the art that such rotatable coupling may be facilitated by any other mechanism known in the art without departing from the scope of the present disclosure.

Accordingly, upon applying a grasping force to the pair of handle members 102*a*, 102*b*, due to the pivotal coupling therebetween, the pair of handle members 102*a*, 102*b* converges towards each other. Thereafter, the locking member 192 is moved about the bolt member 198 in a manner such that the second end portion 196 of the locking member 192 is hooked on the knob 190, thereby allowing the locking mechanism 110 to lock the pair of handle members 102*a*, 102*b* to attain the locked state. Further, upon removing the hooked second end portion 196 from the knob 190 the pair of handle members 102*a*, 102*b* may separate from each other. Specifically, due the retraction of the spring member 108 the pair of handle members 102*a*, 102*b* may separate from each other for attaining the unlocked state.

In the locked state and the unlocked state of the pair of handle member 102*a*, 102*b* the pair of jaw members 106*a*, 106*b* is allowed to attain a closed position and an open position, respectively. More specifically, as shown in FIG. 2A, in the locked state of the pair of handle members 102*a*, 102*b* the pair of jaw members 106*a*, 106*b* is allowed to attain the closed position. Further, as shown in FIG. 2B, in the unlocked state of the pair of handle members 102*a*, 102*b* the pair of jaw members 106*a*, 106*b* is allowed to attain the open position. Accordingly, the hand tool 100 of the present disclosure is capable of being used for assembling and disassembling the plurality of workpieces with the pair of jaw members 106*a*, 106*b* in the closed position and the open position thereof.

Figure 4:
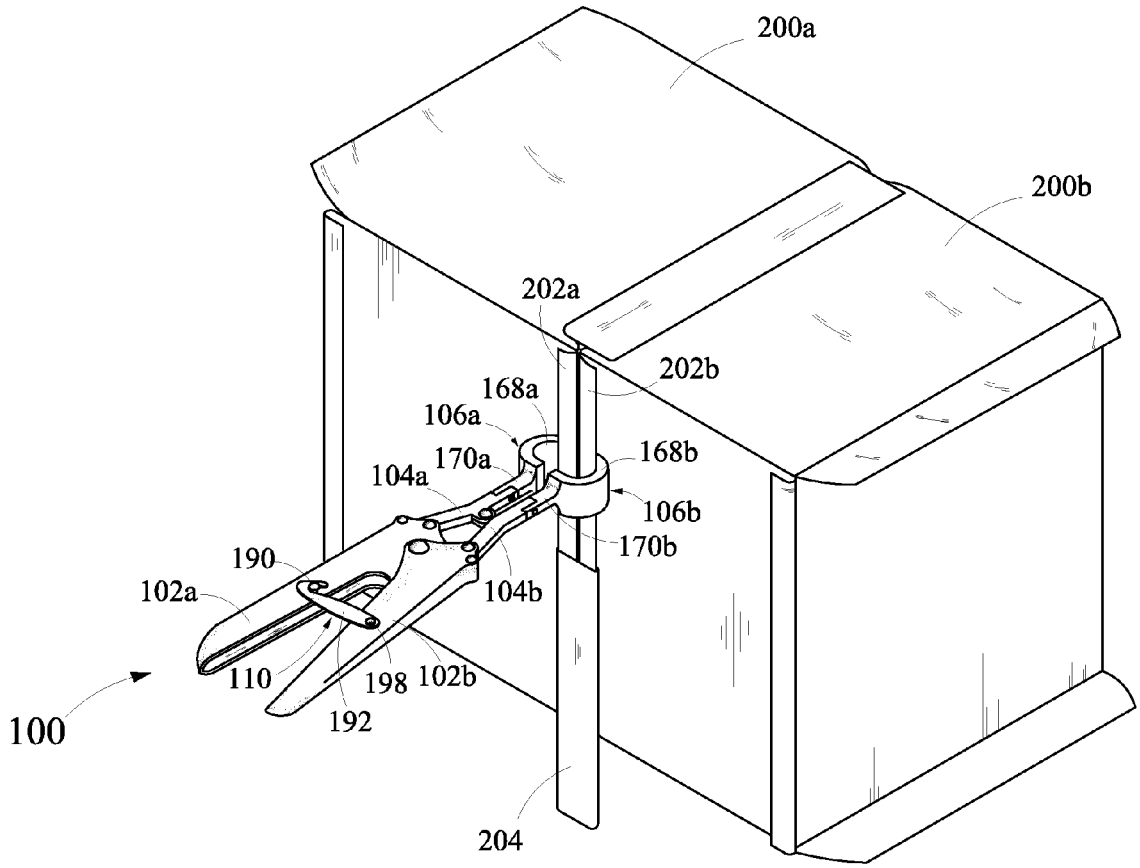
FIG. 4 illustrates an exemplary environment showing the hand tool of FIGS. 1, 2A, and 2B gripping a plurality of workpieces together in the locked state thereof for assembling the plurality of workpieces, in accordance with an embodiment of the present disclosure.

In use, the pair of jaw members 106*a*, 106*b* is capable of grasping at least a portion of a workpiece of the plurality of workpieces therebetween. Specifically, upon applying the grasping force to the pair of handle members 102*a*, 102*b* the spring member 108 is compressed and the bottom end portions 114*a* and 114*b* of the pair of handle members 102*a*, 102*b* converge towards each other. Accordingly, the top end portions 112*a* and 112*b* of each of the pair of handle members 102*a*, 102*b* separate from each other. Due to said separation of the pair of handle members 102*a*, 102*b* from each other, the lower end portions 142*a* and 142*b* that are pivotally coupled to the top end portions 112*a* and 112*b* of the pair of intermediate members 104*a*, 104*b* also separate from each other. The separated lower end portions 142*a* and 142*b* of the pair of intermediate members 104*a*, 104*b* allow the upper end portions 144*a* and 144*b* of the pair of intermediate members 104*a*, 104*b* to converge towards each other. Accordingly, the pair of jaw members 106*a*, 106*b* coupled to the upper end portions 144*a* and 144*b*, attains the closed position for grasping the at least a portion of the workpiece therebetween, as shown in FIG. 4. Further, upon grasping the at least a portion of the workpiece, the pair of handle members 102*a*, 102*b* are held in the locked state by the locking mechanism 110. In an embodiment of the present disclosure, the at least a portion of the work pieces may be a drive edge.

Furthermore, when the grasping force is removed from the pair of handle members 102*a*, 102*b* the spring member 108 is retracted and the bottom end portions 114*a* and 114*b* of the pair of handle members 102*a*, 102*b* separates from each other. Therefore, the top end portions 112*a* and 112*b* of the pair of handle members 102*a*, 102*b*, respectively move towards each other. Moreover, the lower end portions 142*a* and 142*b*, pivotally coupled to the top end portions 112*a* and 112*b* of the pair of handle members 102*a*, 102*b*, respectively, of the pair of intermediate members 104*a*, 104*b* also converge towards each other. Accordingly, the upper end portions 144*a* and 144*b* of the pair of handle members 102*a*, 102*b*, respectively, separates from each other, as shown in FIG. 2B. Therefore, the pair of jaw members 106*a*, 106*b*, coupled to the upper end portions 144*a* and 144*b* of the pair of handle members 102*a*, 102*b*, respectively, attains the open position for releasing the grasped portion of the workpiece from therebetween.

Such movement, particularly, attaining the open position of the pair of jaw members 106*a*, 106*b* by way of retraction of the spring member 108 enables the hand tool 100 to be used by single hand of an individual. More specifically, the hand tool 100 avoids a necessity of using both hands of the individual for separates the pair of handle members 102*a*, 102*b* from each other for allowing the pair of jaw members 106*a*, 106*b* to attain the open position. Accordingly, while assembling or disassembling the plurality of workpieces, the hand tool 100 may used with the single hand of the individual with the repeated opening of the pair of jaw members 106*a*, 106*b* due to the retraction of the spring member 108.

Referring now to FIG. 4, an environment for utilizing the hand tool 100 for assembling a plurality of workpieces, such as a workpiece 200*a* and a workpiece 200*b* together in the locked state thereof is illustrated, in accordance with an embodiment of the present disclosure. In the present embodiment, the hand tool 100 is shown and explained to be used for assembling and disassembling the workpieces 200*a* and 200*b*, such as duct pieces. However, it will be evident to those skilled in the art that the hand tool 100 may be used for performing other tasks such as, pulling fence wires, cutting wires, pulling nails and the like.

Generally, the workpieces 200*a* and 200*b*, such as duct pieces, are assembled to form a long duct for use in a duct system. Typically, the workpieces 200*a* and 200*b* are fabricated in a sheet metal shop by a method which is known in the art. For example, while fabricating a workpiece, such as the workpiece 200*a*, two pieces of sheets (not shown) are assembled along the edges thereof. Further, fabrication of the workpieces 200*a* and 200*b* is done with the help of a Pittsburgh edge and a one-fourth of an inch edge, each configured on the two pieces of sheets. The Pittsburgh edge comprises a groove capable of receiving the one-fourth of an inch edge therein. Further, the Pittsburgh edge provides a tab of about one-fourth of an inch extending above the one-fourth of an inch edge. A hammer may be used to bend the tab provided by the Pittsburgh edge for coupling the Pittsburgh edge and the one-fourth of an inch edge with each other, thereby securing the two pieces of sheets for the fabrication of the workpiece, such as the workpiece 200*a*.

As shown in FIG. 4, the workpieces 200*a* and 200*b* may be placed adjacent to each other with the hand tool 100 may grip a portion 202*a* of the workpiece 200*a*, and a portion 202*b* of the workpiece 200*b* together. More specifically, the hand tool 100 may grip the portion 202*a*, such as a drive edge (180 degree curled), of the workpiece 200*a* and the portion 202*b*, such as a drive edge (180 degree curled), of the workpiece 200*b* together. Further, as shown in FIG. 4, the portion 202*a* of the workpiece 200*a* and the portion 202*b* of the workpiece 200*b* are coupled to each other with the help of a drive cleat 204. The drive cleat 204 includes a channel (not shown) capable of receiving the portions 202*a* and 202*b* therein. Accordingly, the drive cleat 204 facilitates coupling of the workpiece 200*a* and the workpiece 200*b* upon covering an entire length of the portions 202*a* and 202*b*, such as the drive edges of the workpieces 200*a* and 200*b*.

For movement of the drive cleat 204 along the entire length of the portions 202*a* and 202*b*, the drive cleat 204 may be hammered. In such instance, as shown in FIG. 4, the hand tool 100 is gripping the portions 202*a* and 202*b* of the workpieces 200*a* and 200*b* together, thereby allowing the individual for performing the hammering task. More specifically, the pair of handle members 102*a*, 102*b* of the hand tool 100 is allowed to attain the locked state with the help of the locking mechanism 110, thereby allowing the pair of jaw members 106*a*, 106*b* to fixedly grip the portions 202*a* and 202*b* of the workpieces 200*a* and 200*b* therebetween. Accordingly, the hand tool 100 avoids the use of individual's hand for supporting the hand tool 100 while gripping the workpieces 200*a* and 200*b* together, thereby allowing the individual's hand for performing the hammering task. Therefore, the hand tool 100 of the present disclosure facilitates assembling the workpieces 200*a* and 200*b*, such as the duct pieces, in an effortless and speedy manner.

Further, for the purpose of maintenance or case of any error, the assembled workpieces, such as the workpieces 200*a* and 200*b*, may be disassembled from each other with the help of the hand tool 100. Furthermore, the edges, such as the Pittsburgh edge and the one-fourth of an inch edge, may be opened with the help of the pair of jaw members 106*a*, 106*b* of the hand tool 100. In an advantageous embodiment of the present disclosure, the hand tool 100 may be utilized in a confined space for assembling and disassembling the workpieces, as explained in conjunction with FIG. 5.

Figure 5:
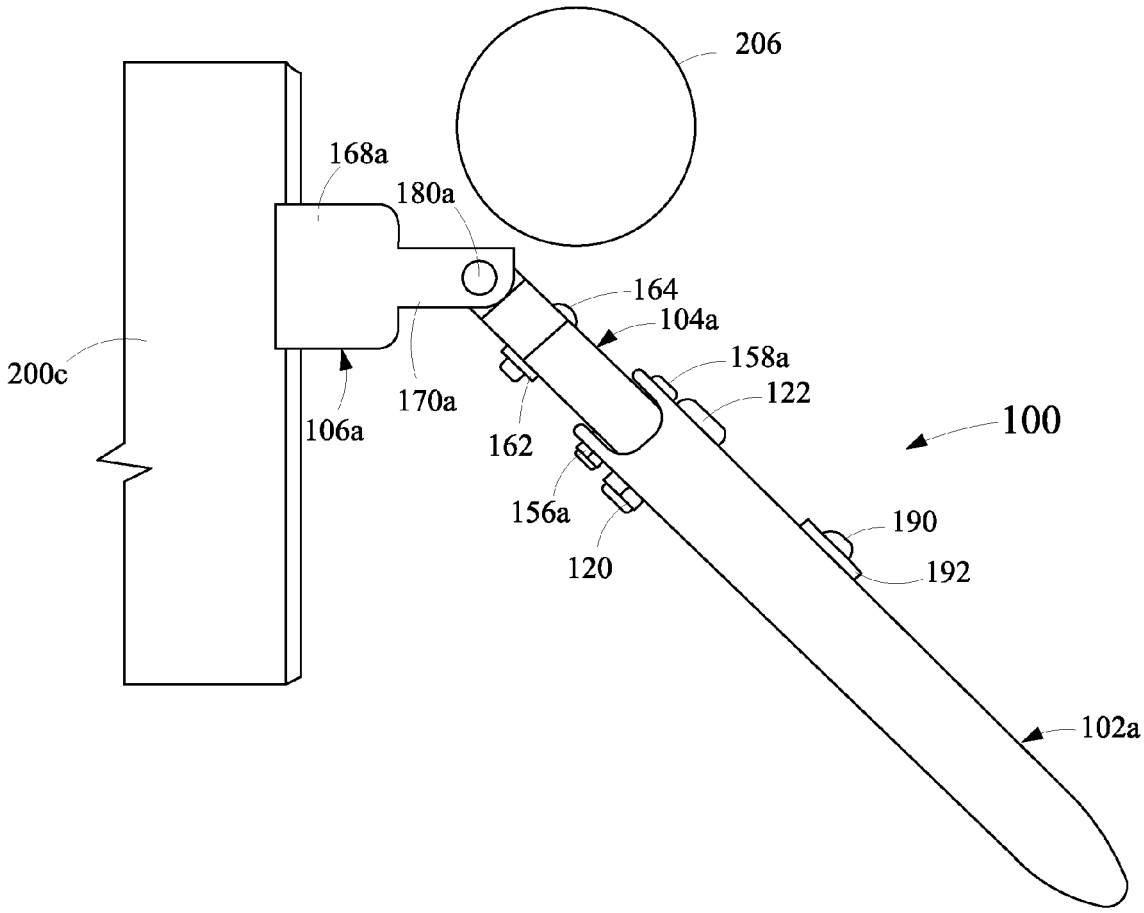
FIG. 5 illustrates an exemplary environment showing utilization of the hand tool of FIGS. 1, 2A, and 2B in a confined space, in accordance with an embodiment of the present disclosure.

Referring to FIG. 5, an environment for utilizing the hand tool 100 in a confined space is illustrated, in accordance with an embodiment of the present disclosure. More specifically, the hand tool 100 may grip a workpiece, such as a workpiece 200*c*, positioned adjacent to a structure, such as a pipe or wall. For example, as shown in FIG. 5, the workpiece 200*c* is positioned closed to a structure, such as a pipe 206, and accordingly a space therebetween may be a confined space for operating the hand tool 100 therein. However, the hand tool 100 disclosed herein is capable of being used in the confined space for assembling and disassembling workpieces.

As explained herein, the pair of jaw members 106*a*, 106*b* is pivotally coupled to the pair of intermediate members 104*a*, 104*b*. For example, the neck portion 170*a* of the first jaw member 106*a* is pivotally coupled to the upper end portion 144*a* of the first intermediate member 104*a* by the fourth bolt 180*a*, and the neck portion 170*b* of the second jaw member 106*b* is pivotally coupled to the upper end portion 144*b* of the second intermediate member 104*b* by the fourth bolt 180*b*, as shown in FIG. Accordingly, the pair of jaw members 106*a*, 106*b* may be pivotally moved or bent with respect to the pair of intermediate members 104*a*, 104*b* for being accommodated in the confined space between the workpiece 200*c* and the pipe 206 in a manner as shown in FIG. 5. Further, the pair of jaw members 106*a*, 106*b* may be retained at the predetermined angles, such as 45 degrees and 90 degrees, with respect to the pair of intermediate member 106*a* and 106*b* with the help of roller bearings, such as the roller bearing 302*a*, as explained in conjunction with FIG. 3. Accordingly, the hand tool 100 of the present disclosure is capable of being utilized in the confined spaced for assembling and disassembling the workpieces, such as duct pieces, due to the pivotal movement of the pair of jaw members 106*a*, 106*b*.

In an exemplary embodiment illustrated in FIG. 5, the pair of jaw members 106*a*, 106*b* is shown to be aligned at about 45 degrees with respect to the pair of intermediate members 104*a*, 104*b* for being accommodated in the confined space, as explained in conjunction with FIG. 3. However, the pair of jaw members 106*a*, 106*b* of the hand tool 100 is capable of being pivotally moved up to 90 degrees for being accommodated in a confined space. Moreover, after the use of the hand tool 100 in the limited space, the pair of jaw members 106*a*, 106*b* may be pivotally moved to align themselves with the pair of intermediate members 104*a*, 104*b*.

The hand tool, such as the hand tool 100, provides a convenient and a speedy way for assembling and disassembling workpieces, such as duct pieces. More specifically, the hand tool is capable of being used with one hand by an individual for assembling and disassembling workpieces. Further, the hand tool is capable of gripping workpieces together without a support of an individual's hand. Furthermore, the hand tool is capable of being used in a constrained space for assembling and disassembling workpieces. Moreover, the hand tool of the present disclosure may be used for performing other tasks apart from assembling and disassembling workpieces, such as pulling fence wires, cutting wires, pulling nails and the like.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A hand tool for assembling and disassembling a plurality of workpieces, the hand tool comprising:

a pair of handle members, each handle member of the pair of handle members comprising a top end portion, a bottom end portion, and a coupling portion extending sideways from the top end portion, the pair of handle members pivotally coupled to each other at respective coupling portions;

a pair of intermediate members, each intermediate member of the pair of intermediate members comprising a lower end portion, an upper end portion, and an attaching portion extending between the upper end portion and the lower end portion, the lower end portion of each of the pair of intermediate members pivotally coupled to the top end portion of respective handle member of the pair of handle members, wherein the pair of intermediate members is pivotally coupled to each other at respective attaching portions;

a pair of jaw members, each of the pair of jaw members pivotally coupled to the upper end portion of respective intermediate member of the pair of intermediate members, wherein each of the pair of jaw members further comprise a gripping portion, the gripping portion configured to form a C-shaped structure, the gripping portion of the pair of jaw members capable of grasping at least a portion of a workpiece of the plurality of workpieces therebetween, when the C-shaped structure of the gripping portion of each of the pair of jaw members are disposed toward one another;

a pair of retainer springs and a pair of roller bearings disposed on the pair of retainer springs, each of the pair of roller bearings being mounted between a jaw member of the pair of jaw members and the respective upper end portion of each of the pair of intermediate members, wherein the pair of retainer springs and the pair of roller bearings are adapted to retain the pair of jaw members at one or more predetermined angles with respect to the pair of intermediate members;

a spring member mounted between the pair of handle members, the spring member capable of being compressed and retracted based on a pivotal movement of the pair of handle members; and a locking mechanism configured on the pair of handle members, the locking mechanism adapted to enable the pair of handle members to attain one of a locked state and an unlocked state, wherein upon applying a grasping force to the pair of handle members, the spring member is compressed and the pair of intermediate members converge towards each other thereby allowing the gripping portion of the pair of jaw members to grasp the at least a portion of the workpiece therebetween for assembling and disassembling the plurality of workpieces, and wherein upon grasping the at least a portion of the workpiece, the pair of handle members are held in the locked state by the locking mechanism.

2. The hand tool of claim 1, wherein the upper end portion of each of the pair of intermediate members comprises a slot configured therein for receiving a retainer spring of the pair of retainer springs.

3. The hand tool of claim 1, wherein each of the pair of jaw members comprises a plurality of indentations, the plurality of indentations being capable of partially receiving a roller bearing of the pair of roller bearings to retain the pair of jaw members at the one or more predetermined angles with respect to the pair of intermediate members.

* * * * *